United States Patent [19]

Zepp

[11] Patent Number: 4,644,893

[45] Date of Patent: Feb. 24, 1987

[54] POSITION INDICATING APPARATUS FOR USE IN A BOAT LEVELING SYSTEM

[75] Inventor: Lawrence P. Zepp, Toledo, Ohio

[73] Assignee: International Hydraulic Systems, Inc., Southgate, Mich.

[21] Appl. No.: 638,233

[22] Filed: Aug. 6, 1984

[51] Int. Cl.[4] ..... B63B 1/22

[52] U.S. Cl. ..... 114/286; 338/154; 340/689

[58] Field of Search ..... 114/284–287; 440/2; 340/689; 338/150, 154, 158, 202

[56] References Cited

U.S. PATENT DOCUMENTS

| | | | |
|---|---|---|---|
| 3,062,167 | 11/1962 | Bennett | 114/66.5 |
| 3,111,103 | 11/1963 | Bennett | 114/66.5 |
| 3,326,164 | 6/1967 | Kercheval | 114/66.5 |
| 3,399,643 | 9/1968 | Bennett | 114/66.5 |
| 3,468,278 | 9/1969 | Kercheval | 114/66.5 |
| 3,589,323 | 6/1971 | Kercheval | 114/66.5 |
| 3,626,350 | 12/1971 | Suzuki et al. | 338/69 |
| 3,628,487 | 12/1971 | Bennett | 114/66.5 |
| 3,695,204 | 10/1972 | Bennett | 114/66.5 |
| 3,764,953 | 10/1973 | Lehnert | 338/154 |
| 3,814,044 | 6/1974 | Kercheval | 114/66.5 |
| 3,844,247 | 10/1974 | Collis et al. | 440/2 |
| 4,140,045 | 2/1979 | Hardwick et al. | 92/5 R |
| 4,176,586 | 12/1979 | Stoil et al. | 92/5 R |
| 4,333,068 | 6/1982 | Kishel | 338/158 |
| 4,386,552 | 6/1983 | Foxwell | 91/1 |
| 4,420,741 | 12/1983 | West | 440/2 |

*Primary Examiner*—Trygve M. Blix
*Assistant Examiner*—Stephen P. Avila
*Attorney, Agent, or Firm*—Cullen, Sloman, Cantor, Grauer, Scott and Rutherford

[57] ABSTRACT

A boat leveling systems with a pair of trim tabs pivotal between a horizontal position and a downwardly inclined position. Each trim tab is actuatably between the horizontal and inclined positions by a separate fluid motor which includes a cylinder, a piston slidably disposed in the cylinder and a rod connected to the piston. The position of each trim tab is indicated by apparatus which includes a linear potentiometer attached to the rod of the associated fluid motor, the potentiometer having a flexible plastic envelope and a pair of normally spaced-apart conductive strips sealed in the envelope, a ball and spring carried by the cylinder for contacting the envelope and forcing the strips into electrical contact with each other, and a resistance measuring device connected in circuit with the potentiometer and to provide a readout in degrees of the downward angle from horizontal of the trim tab.

10 Claims, 6 Drawing Figures

POSITION INDICATING APPARATUS FOR USE IN A BOAT LEVELING SYSTEM

BACKGROUND OF THE INVENTION

This invention relates to boat leveling systems, and more specifically to position indicating apparatus for use in such systems.

The design of power boats frequently produces a boat which runs bow high, a condition which can be further aggravated by a heavy fuel load or a heavy passenger load or both. While a power boat that runs bow high provides positive response to rudder action and gives good handling in a following sea, a power boat which runs approximately level fore-to-aft generally is preferable because of certain advantages incurred from running level such as higher speed at a given throttle setting, improved fuel consumption, better visibility, reduced pounding and so on. As a result of the many advantages of running a boat level, the use of boat leveling systems to maintain a boat level while underway is increasing.

While boat leveling systems provide many advantages, none of the boat leveling systems of which I am aware are provided with any apparatus for determining the position of the trim tabs of the boat leveling system with the boat either at rest or underway. This is a disadvantage in that each time the operator of a power boat "levels" or "trims" it, he has to adjust the boat leveling system while the boat is underway at a given throttle setting until he is satisfied with how the boat is running.

My invention overcomes the problem described above by providing position indicating apparatus for a boat leveling system. Thus, it is possible for a boat operator to set the trim tabs of the boat leveling system at predetermined positions (indicated in degrees of downward angle) before getting underway with the boat. Further, the boat operator can go to a particular setting of the trim tabs at any time since the position indicating apparatus provides the boat operator with a positive and direct indication of trim tab positions. This is advantageous if, for example, the boat operator has determined the "level" or "trim" of the boat for minimum fuel consumption at a specific throttle setting.

BRIEF SUMMARY OF THE INVENTION

This invention relates to apparatus for indicating the positions of trim tabs in a boat leveling system. In a preferred embodiment, the apparatus includes for each trim tab a single acting fluid motor having a cylinder, a piston slidably disposed in the cylinder and a rod connected to the piston; a linear potentiometer attached to the rod, the potentiometer having a flexible plastic envelope and a pair of normally spaced-apart conductive strips sealed in the envelope; means carried by the cylinder for contacting the envelope and forcing the strips into electrical contact with each other; and resistance measuring means connected in circuit with the pair of strips and calibrated to provided a readout in degrees of downward angle of the associated trim tab.

It is a principal object of my invention to provide apparatus for indicating the positions of the trim tabs in a boat leveling system.

Another object of my invention is to provide low cost and simple apparatus for indicating the extension of a piston and cylinder type fluid motor.

The above and other objects, features and advantages will become apparent upon consideration of the detailed description and appended drawing.

DETAILED DISCRIPTION OF THE PREFERRED EMBODIMENT

Figure 1:
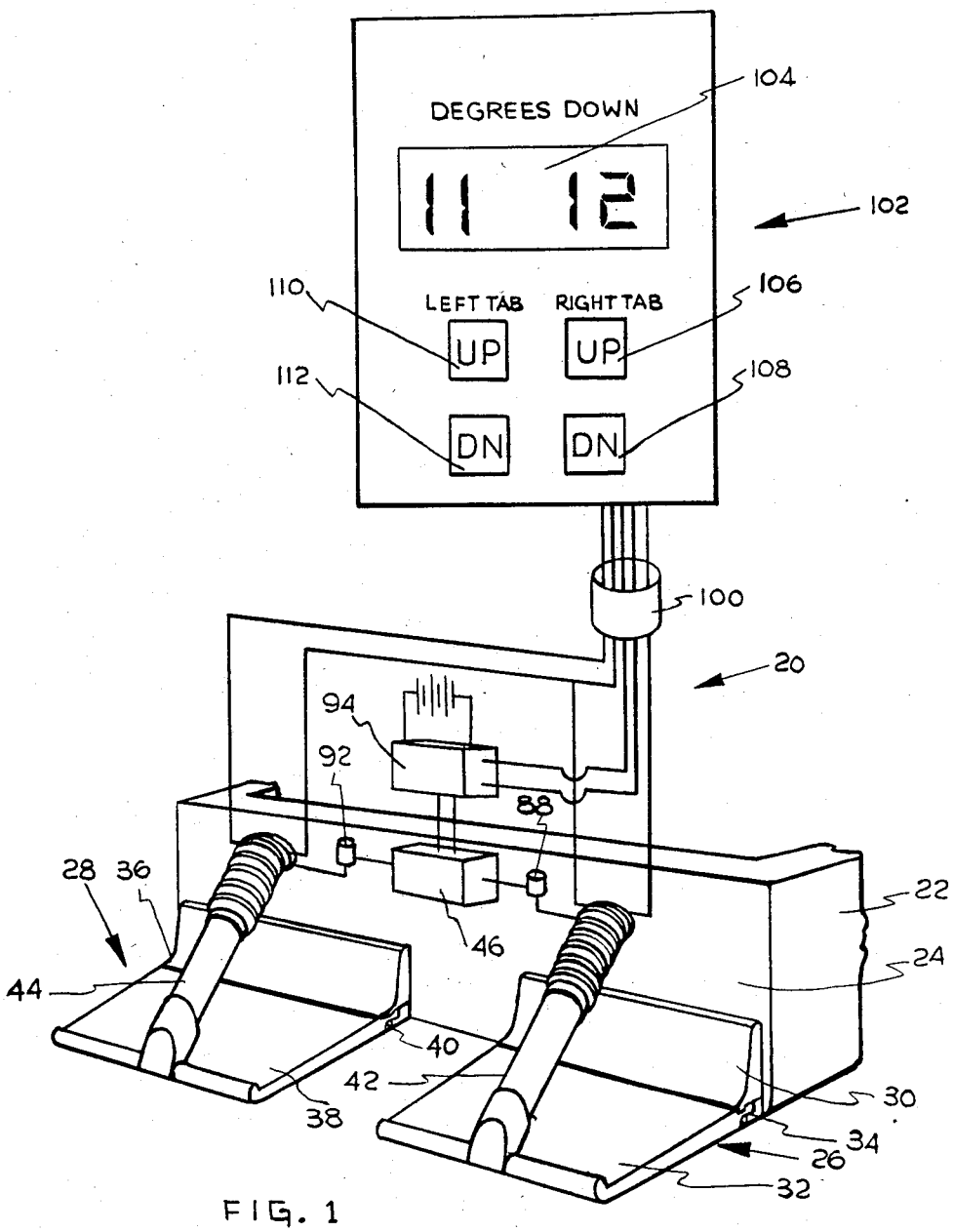
FIG. 1 shows a boat leveling system with my position indicating apparatus.

Referring to FIG. 1, reference number 20 denotes a boat leveling system used with a power boat 22 having a transom 24. Boat leveling system 20 includes a pair of trim tabs 26 and 28 attached to the lower edge of transom 24 as shown. Right trim tab 26 includes a fixed portion 30 and a movable portion 32 which is connected to portion 30 by a suitable hinge 34 for pivotal movement between a substantially horizontal position and a downwardly and rearwardly extending position. Similarly, left trim tab 28 includes a fixed portion 36 and a movable portion 38 connected to fixed portion 36 by a hinge 40.

Movable portion 32 of trim tab 26 is actuatable between its horizontal and downwardly extending positions by a single action fluid motor 42 pivotally connected at its head end to movable portin 32 and pivotally connected at its rod end to transom 24. Trim tab 28 also is provided with a single acting fluid motor 44 pivotally connected at its head end to movable portion 38 and pivotally connected at its rod end to transom 24.

Boat leveling system 20 also includes a pump and motor assembly 46 which serves as the source of pressurized fluid to operate fluid motors 42 and 44.

Figure 3:
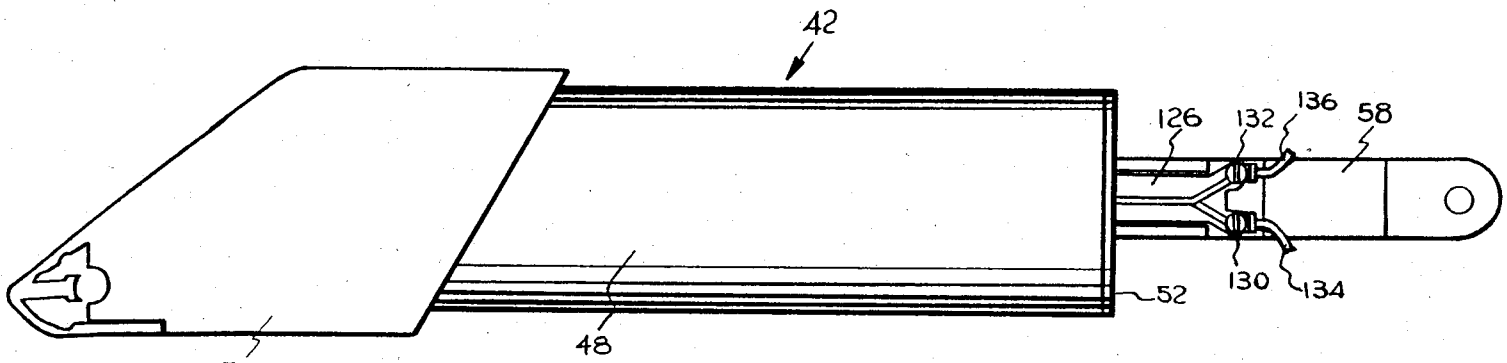
FIG. 3 shows a piston and cylinder type fluid motor to which a linear potentiometer is attached.
Figure 4:
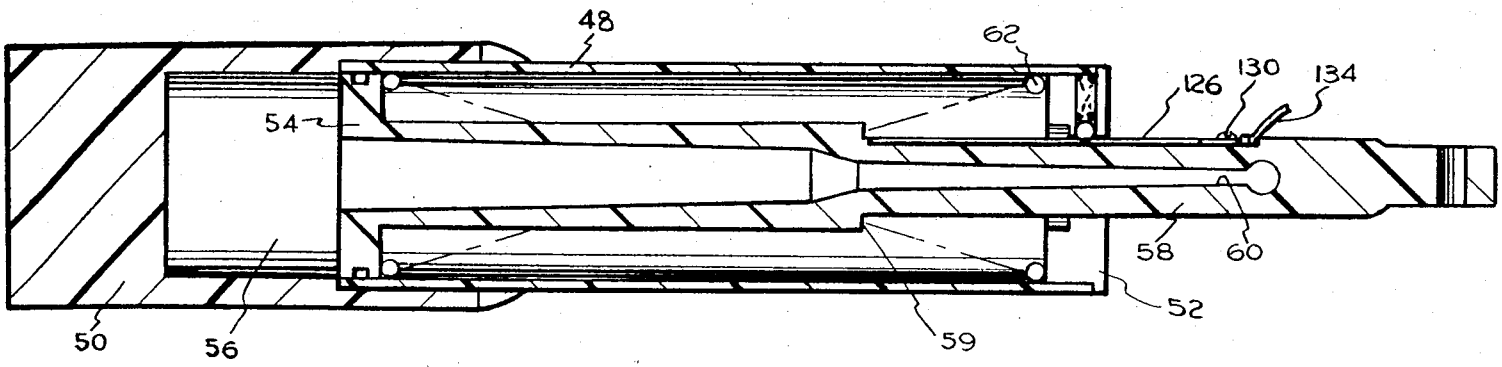
FIG. 4 is a longitudinal section of the fluid motor shown in FIG. 3, but rotated 90° about its longitudinal axis.
Figure 5:
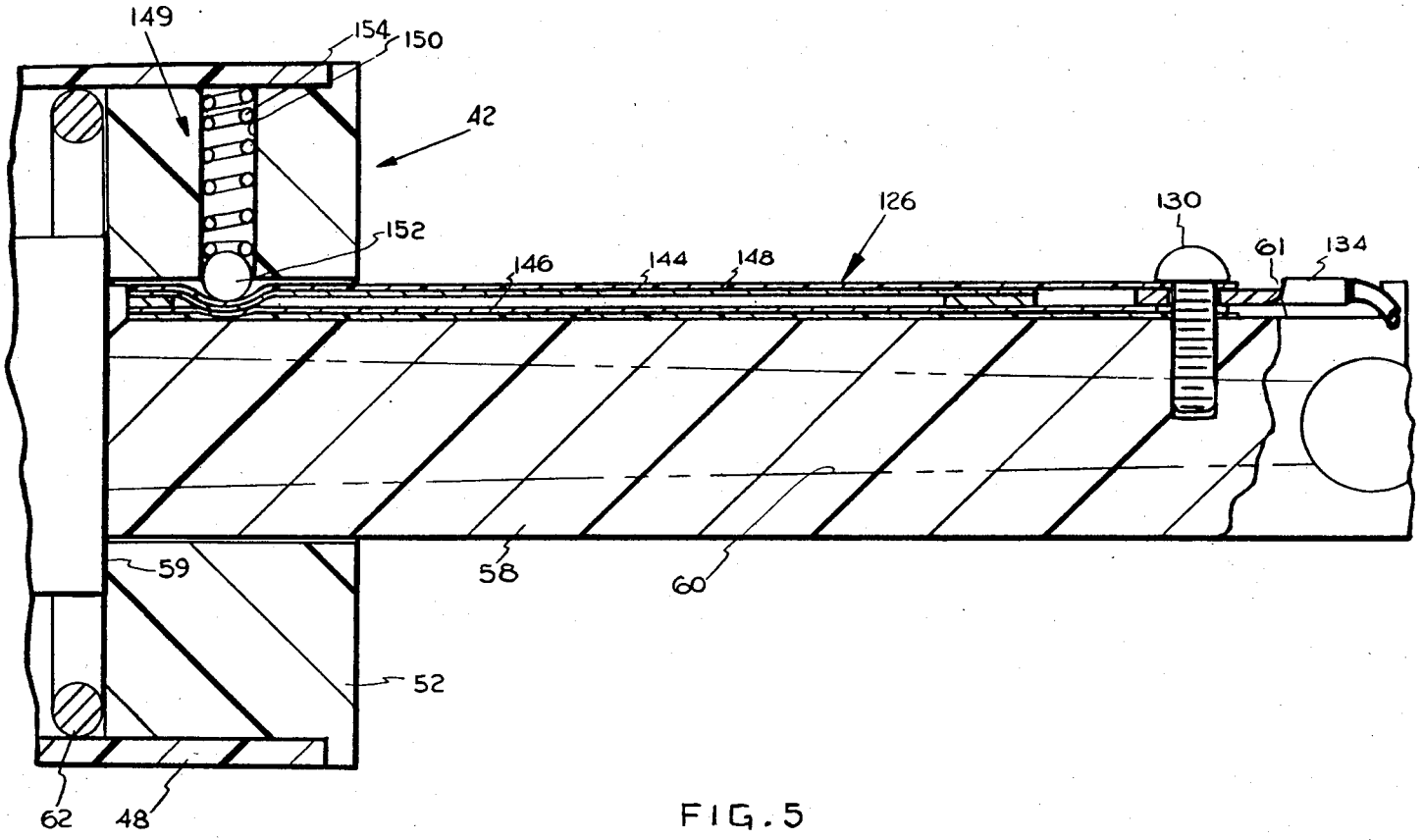
FIG. 5 is an enlarged fragmentary view from FIG. 4 showing to advantage the potentiometer.

Referring now also to FIGS. 3, 4 and 5, the construction of fluid motor 42 will be described in some detail. Fluid motor 42 includes a cylinder 48 with a head end 50 and a rod end 52. Slidably disposed within cylinder 48 is a piston 54 which defines with head end 50 a fluid chamber 56. Connected to piston 54 is a rod 58 which extends outwardly through end 52. Rod 58 preferably is rectangular in cross section past a shoulder 59 and includes a slot 61 (FIG. 5) on one side thereof and a longitudinally extending fluid passage 60 which passes through piston 54 and communicates with fluid chamber 56. The outer end of rod 58 is arranged to be pivotally connected to transom 24. Also disposed within cylinder 48 is a compression spring 62 which serves to bias fluid motor 42 to its retracted position. The shoulder 59 on rod 58 serves to limit the extension of fluid motor 42. While fluid motor 44 has not been described in detail it will be appreciated that it is identical with fluid motor 42.

Figure 2:
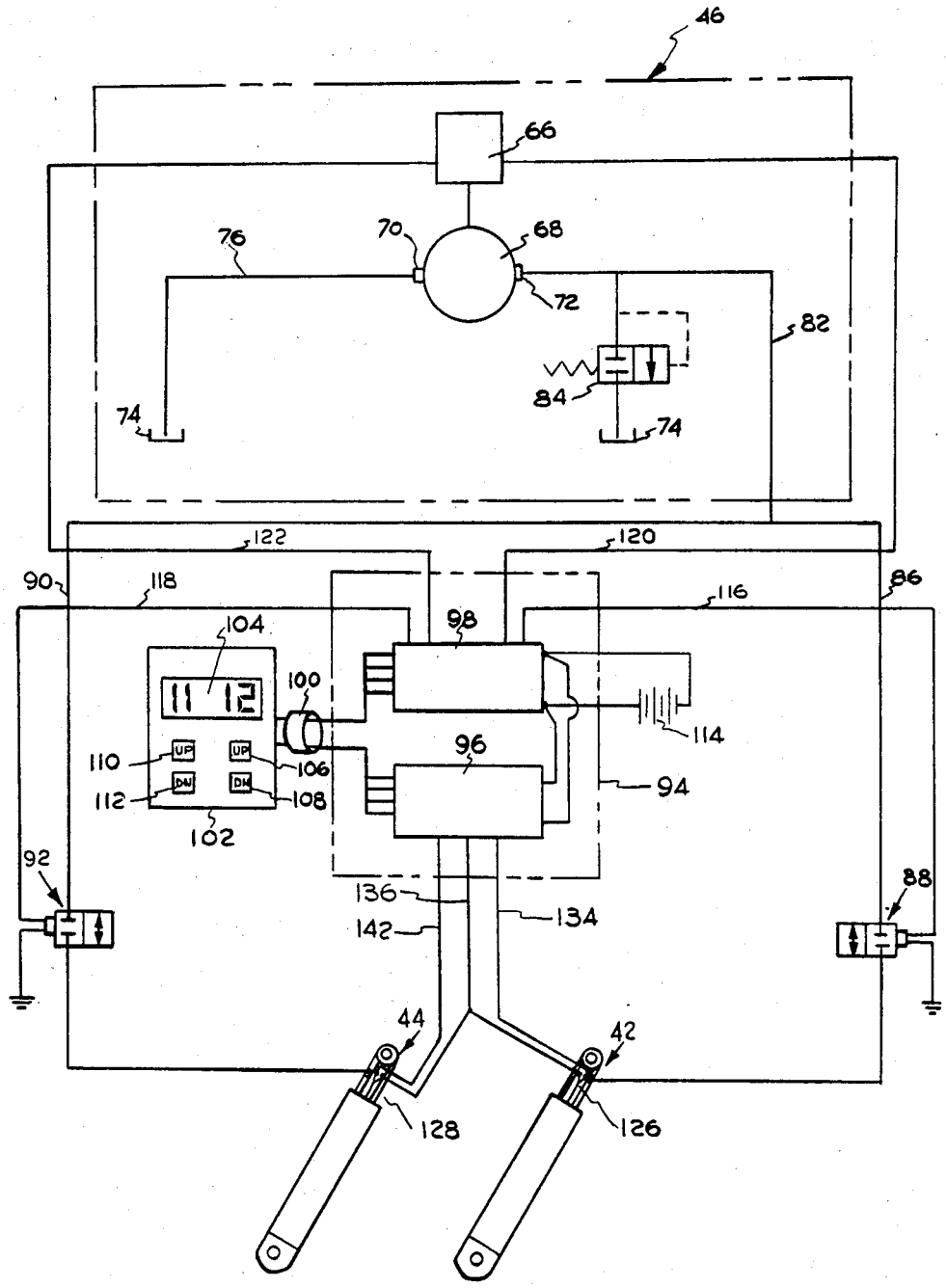
FIG. 2 is a schematic of the electric and hydraulic circuits associated with my invention.

Referring now to FIG. 2, it will be seen that pump and motor assembly 46 includes a reversible 12 volt direct current electric motor 66 which is drivingly connected to a reversible fluid pump 68 which includes a pair of ports 70 and 72. Port 70 is connected to a fluid reservoir or sump 74 by a conduit 76. Connected to port 72 is a conduit 82 to which a pressure relief valve 84 is connected.

Conduit 82 is connected to fluid motor 42 by means of a conduit 86 in which a solenoid actuated on-off valve 88 is located. Similarly, conduit 82 is connected to fluid motor 44 by means of a conduit 90 in which a solenoid actuated on-off valve 92 is located.

Preferably mounted on the inside of transom 24 is a control module 94 within which is disposed a resistance measuring device 96 and a motor and valve control 98. Connected to control module 94 by means of a multi-conductor cable 100 is a display and control panel 102 which preferably is located in the cockpit area of boat 22. Panel 102 includes a dual digital readout 104 from resistance measuring device 96, a pair of buttons 106 and 108 which control upward and downward actuation of trim tab 26 and a pair of buttons 110 and 114 which control upward and downward actuation of trim tab 28. Motor and valve control 98 preferably is an electronic circuit board, but could incorporate, for example, solenoid actuated relays. Control 98 is connected to a source 114 of 12 volt direct current power and also is connected to one side of solenoid actuated valves 88 and 92 by a pair of conductors 116 and 118, respectively. The other side of solenoid actuatedvalves 88 and 92 are grounded. Also, control 98 is connected to electric motor 66 by a pair of conductors 120 and 122.

When it is desired to actuate trim tabs 26 and 28 downwardly from the horizontal position, either separately or simultaneously, an operator depresses buttons 108 and 112 which activates control 98 to energize electric motor 66 and drive pump 68 in a forward direction so that pressurized fluid is supplied through conduit 82, 86, and 90 to valves 88 and 92. Depending upon whether buttons 108 and 112 are simultaneously or separately depressed, appropriate solenoid valve 88 or 92 will be opened to permit pressurized fluid to be delivered to fluid motors 42 and 44, as desired, thereby causing individual or simultaneous extension of the fluid motors, and so moving the associated trim tab downwardly. Similarly, if an operator depresses buttons 106 and 110, control 98 is activated to energize electric motor 66 to drive pump 68 in a reverse direction so that fluid is pulled from conduits 82, 86 and 90. Depending upon which of fluid motors 42 and 44 it is desired to cause to retract, the appropriate solenoid actuated valve 88 or 92 or both, is open. At this point it should be remembered that each fluid motor is provided with a compression spring, spring 62 in regard to motor 42, so that as fluid pressure is decreased in the fluid motor, the spring causes the fluid motor to retract. The force of spring 62, for example, is chosen to be sufficiently large enough to overcome the associated weight of fluid motor 42 and trim tab 26.

Figure 6:
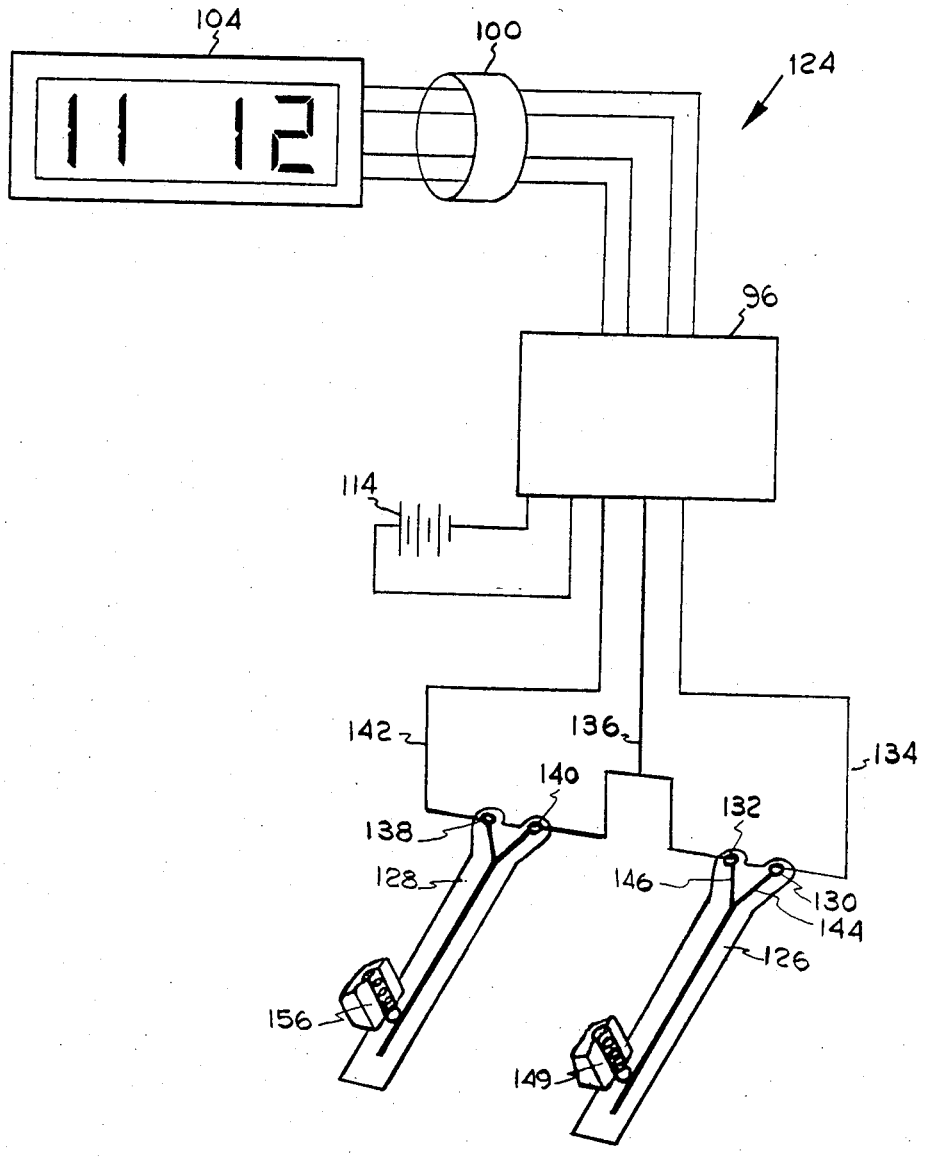
FIG. 6 is a schematic showing of the position indicating apparatus.

Associated with boat leveling system 20 is apparatus 124 for determining the position of trim tabs 26 and 28 and is best seen in FIG. 6. Position indicating apparatus 124 includes, in addition to resistance measuring device 96 and readout 104, a pair of linear potentiometers 126 and 128. Potentiometer 126 is connected at 130 and 132 to resistance measuring device 96 by a pair of conductors 134 and 136. Similarly, potentiometer 128 is connected at 138 and 140 to resistance measuring device 96 by conductor 136 and a conductor 142.

Referring back also to FIGS. 3, 4, and 5, potentiometer 126 includes a pair of normally spaced apart conductive strips 144 and 146 sealed in a flexible plastic envelope 148. Conductive strip 144 is connected to conductor 134 at 130 and conductive strip 146 is connected to conductor 136 at 132. Potentiometer 126 is disposed in slot 61 on rod 58 of fluid motor 42 and fixed to rod 58 by any suitable means, such as adhesive.

Disposed in a bore 150 in end cap 52 of fluid motor 42 is a ball and spring assembly 149 which includes a ball 152 that is biased into contact with potentiometer 126 by a spring 154 with sufficient force to bring conductive strips 144 and 146 into electrical contact with each other. As rod 58 moves in and out of cylinder 48, potentiometer 126 moves past ball 152 with the result that the point of electrical contact between strips 144 and 146 is infinitely variable from one end of potentiometer 126 to the other end. Consequently, the resistance supplied by potentiometer 126 in the circuit to resistance measuring device 96 varies depending upon the extension of fluid motor 42. By measuring this resistance and providing a readout in degrees of downward angle, an operator can determine the position of the associated trim tab.

While only potentiometer 126 has been described in detail it will be understood that potentiometer 128 is identical with potentiometer 126 and is mounted in the same manner in a slot on the rod of fluid motor 44 and is contacted by a ball and spring assembly 156.

OPERATION

In describing the operation of my invention it will be assumed that the operator desires to move trim tab 26 from a horizontal position to a downwardly and rearwardly extending position. In order to do this the operator depresses button 108 which actuates motor and valve control 98 to open valve 88 and energize motor 66 to drive pump 68 in a forward direction so that pressurized fluid is supplied via conduits 82 and 86 to fluid motor 42 thereby causing it to extend. As fluid motor 42 extends, potentiometer 126 is moved outwardly (to the right in FIG. 5) so that the point of electrical contact between conductive strips 144 and 146 moves from a point adjacent connection 130 towards the position shown in FIG. 5 when fluid motor 42 is fully extended and shoulder 59 engages end cap 52. This relative movement toward the left in FIG. 5 of the point of electrical contact between strips 144 and 146 increases the resistance in the circuit to which resistance measuring device 96 is connected. When the readout at 104 of resistance measuring device 96 shows the desired degrees of downward angle of trim tab 26, the operator releases button 108 with the result that motor 66 is denergized and valve 88 closes, thereby hydraulically locking fluid motor 42 to hold trim tab 26 in the desired position. If the operator desires to elevate trim tab 26 from a depressed position or angle, he depresses button 106 thereby activating motor valve control 98 to open valve 88 and energize motor 66 to drive pump 68 in a reverse direction, thereby permitting spring 62 to cause fluid motor 42 to retract since fluid is being taken out of the hydraulic circuit and returned to sump 74. As fluid motor 42 retracts, potentiometer 126 moves inwardly past ball and spring assembly 149 so that the point of electrical contact between conductive strips 144 and 146 moves toward the right and reduces the resistance in circuit with resistance measuring device 96 which is translated into a smaller downward angle on readout 104 from resistance measuring device 96.

It will be understood that buttons 112 and 110 can be actuated in a manner similar to buttons 108 and 106 described above in order to extend or retract fluid motor 44 and thus move trim tab 28 downwardly and upwardly as desired. The position of trim tab 28 is shown in degrees of downward angle by readout 104 of resistance measuring device 96 which is connected in circuit with potentiometer 128 in the same manner as described in detail for potentiometer 126.

While the buttons on control panel 102 can be actuated to move trim tabs 26 and 28 in the same direction either simultaneously or independently, motor and valve control 98 provides electronic circuitry that interlocks the buttons for energizing motor 66 so that it is not possible to energize motor 66 for one direction of rotation by depressing, for example, button 106 and at the same energizing motor 66 for the opposite direction of rotation by depressing button 108 or 112.

While my invention has been disclosed in conjunction with a boat leveling system, it can be used in any application in which an indication of position in conjunction with a fluid motor is desired. My invention is subject to modifications and changes other than those disclosed, so the limits of it should be determined from the appended claims as construed in light of the prior art.

I claim:

1. A trim tab positioning assembly for a boat having a transom comprising a trim tab connected to said transom by a hinge, an extendible fluid motor, the fluid motor having a cylinder member directly pivotally connected to said trim tab on one end, a piston slidably disposed in the cylinder member and a rod member connected to the piston and directly pivotally connected to said transom, position indicating apparatus comprising a linear potentiometer having a flexible plastic envelope and a pair of normally spaced-apart conductive strips sealed in said envelope, a longitudinally extending slot formed in one of said members and said envelope being disposed in said slot, means carried by the other of the members for contacting said envelope and forcing said conductive strips into electrical contact with each other, and resistance measuring means connected in circuit with said conductive strips.

2. The position indicating apparatus as set forth in claim 1 wherein said envelope is attached to the rod member and said contacting and forcing means is attached to the cylinder member, said cylinder member having an end cap at the end through which said rod member extends, said end cap having a bore in which said contacting and forcing means is disposed.

3. The position indicating apparatus as set forth in claim 2 wherein said envelope is elongated, flat and generally rectangular in shape and said contacting and forcing means is a ball and a spring biasing said ball in a direction to force said conductive strips into contact with each other.

4. A trim tab positioning assembly for a boat having a transom comprising a trim tab connected to said transom by a hinge, a cylinder having first and second ends with its first end directly pivotally connected to said trim tab, a piston slidably disposed in said cylinder and defining with said first end a fluid chamber, a rod connected to said piston and extending outwardly through said second end, and directly pivotally connected to said transom, a longitudinally extending slot formed in said rod, a linear potentiometer being disposed in said slot and adapted to be connected in circuit to resistance measuring means, said potentiometer having a flexible plastic envelope and a pair of normally spaced-apart conductive strips sealed in said envelope, and means carried by said second end for contacting said envelope and forcing said strips into electrical contact with each other.

5. An assembly as set forth in claim 4 wherein said contacting and forcing means is a ball disposed in said second end for reciprocal movement and a spring biasing said ball into contact with said envelope.

6. An assembly as set forth in claim 4 wherein said rod includes a slot, said potentiometer being disposed in said slot and movable reciprocally with said rod past said second end.

7. An assembly as set forth in claim 5 wherein said rod includes a slot, said potentiometer being disposed in said slot and movable reciprocally with said rod past said ball.

8. An assembly as set forth in claim 7 and including a compression spring disposed in said cylinder between said piston and said second end.

9. For use with a boat having a transom and a trim tab connected to the transom for pivotal movement between a horizontal position and a downwardly and rearwardly inclined position, an assembly comprising a cylinder having first and second ends, a piston slidably disposed in said cylinder and defining with said first end a fluid chamber, a rod connected to said piston and extending outwardly through said second end, said rod includes a fluid passage in fluid communication with said fluid chamber and a source of pressurized fluid, said first end being directly pivotally connectible to the trim tab and the end of said rod remote from said piston being directly pivotally connectible to the transom, a compression spring disposed in said cylinder between said piston and said second end, a linear potentiometer attached to said rod and adapted to be connected in circuit to resistance measuring means, said rod having a slot, said potentiometer being disposed in said slot, said potentiometer having a flexible plastic envelope and a pair of normally spaced-apart conductive strips sealed in said envelope, and means carried by said second end for contacting said envelope and forcing said strips into electrical contact with each other.

10. For use with a boat having a transom, a boat leveling system comprising first and second trim tabs, each trim tab being connected to the transom for pivotal movement between a horizontal position and a downwardly and rearwardly extending piston, a pair of single acting fluid motors, each fluid motor being pivotally connected between the transom and a different one of said trim tabs and including a cylinder having first and second ends, with its first end directly pivotally connected to a trim tab, a piston slidably disposed in said cylinder to define with said first end a fluid chamber, a rod connected to said piston and extending outwardly through said second end, said rod being directly pivotally connected to said transom and including a fluid passage which communicates with said fluid chamber and is connectible to a source of pressurized fluid and a compression spring disposed in said cylinder between said piston and said second end, a linear potentiometer attached to each of said rod, each of said potentiometers having a flexible plastic envelope and a pair of normally spaced-apart conductive strips sealed in said envelope, means carried by each of said cylinders for contacting the envelope and forcing the strips of the respective potentiometer into electrical contact with each other, and resistance measuring means connected in circuit with each pair of strips so as to provide a separate readout of the resistance in the circuit attributable to each pair of strips dependent upon the location of the associated contacting and forcing means relative to the pair of strips, each readout of said resistance measuring means being calibrated in degrees of downward angle of the associated trim tab.

* * * * *